US007771112B2

(12) United States Patent
Morgan

(10) Patent No.: US 7,771,112 B2
(45) Date of Patent: Aug. 10, 2010

(54) WATCH BAND OR OTHER WRIST-BORNE DEVICE ASSEMBLIES

(75) Inventor: Garth Morgan, Portland, OR (US)

(73) Assignee: Nike, Inc., Beaverton, OR (US)

( * ) Notice: Subject to any disclaimer, the term of this patent is extended or adjusted under 35 U.S.C. 154(b) by 9 days.

(21) Appl. No.: 11/850,402

(22) Filed: Sep. 5, 2007

(65) Prior Publication Data

US 2008/0074958 A1 Mar. 27, 2008

Related U.S. Application Data

(60) Provisional application No. 60/825,142, filed on Sep. 10, 2006.

(51) Int. Cl.
*A44C 5/00* (2006.01)

(52) U.S. Cl. ..... 368/281

(58) Field of Classification Search ..... None
See application file for complete search history.

(56) References Cited

U.S. PATENT DOCUMENTS

| | | | | |
|---|---|---|---|---|
| 1,968,444 | A * | 7/1934 | Farber | 40/117 |
| 2,189,096 | A | 2/1940 | Alonge | |
| 2,472,351 | A | 6/1949 | Tyler | |
| 3,789,601 | A * | 2/1974 | Bergey | 368/69 |
| 4,178,751 | A * | 12/1979 | Liautaud | 368/281 |
| 4,627,738 | A * | 12/1986 | Kao | 368/281 |
| 5,899,370 | A * | 5/1999 | Bould | 224/175 |
| 7,591,582 | B2 * | 9/2009 | Hiranuma et al. | 368/308 |
| 2006/0193210 | A1 * | 8/2006 | Damasko | 368/295 |

FOREIGN PATENT DOCUMENTS

| | | |
|---|---|---|
| DE | 35 40 737 A1 | 5/1987 |
| DE | 94 09 605 U1 | 9/1994 |

OTHER PUBLICATIONS

International Search Report and Written Opinion mailed Mar. 11, 2008 in Application No. PCT/US2007/019616.

* cited by examiner

*Primary Examiner*—Edwin A. Leon
(74) *Attorney, Agent, or Firm*—Banner & Witcoff, Ltd.

(57) ABSTRACT

Wrist-borne structures (such as watches) include: (a) a wrist band assembly defining a recess and a first aperture; (b) an electronic or mechanical device assembly having a first control element positioned in the recess so as to be accessible at the first aperture; and (c) a first user interaction element engaged with the first control element via the first aperture. The first user interaction element may be at least partially located external to the recess and at least partially on an opposite side of the recess from the first control element. Methods for assembling watches or other wrist-borne structures like those described above also are described.

25 Claims, 4 Drawing Sheets

WATCH BAND OR OTHER WRIST-BORNE DEVICE ASSEMBLIES

RELATED APPLICATION DATA

This application claims priority benefits under 35 U.S.C. §119(e)(1) based on U.S. Provisional Patent Appln. No. 60/825,142 entitled "Watch Band Assembly," filed Sep. 10, 2006 in the name of Garth Moran. This earlier provisional patent application is entirely incorporated herein by reference.

FIELD OF THE INVENTION

The present invention relates to watches or other devices including a wrist band assembly. Various examples of the invention may be particularly applicable to wrist band assemblies that form a casing for a watch movement or other electronic or mechanical device.

BACKGROUND OF THE INVENTION

Traditionally, wristwatches were formed of three major components: a movement, a display connected to the movement, and a movement casing. The movement casing held the movement and was formed with relatively thick walls of impact-resistant material, such as metal, to protect the movement. The display then fit into or over the movement casing. Typically, the movement casing included a lug on either side, to which was attached a simple watch band formed of leather or of interconnected metal links. According to modem watch styles, however, the watch band often is attached to the movement casing so that the watch band, the movement casing, and the display appear to all be formed as an integral unit.

For example, with some modem style watches, the watch band is formed from a single piece of material, such as a plastic or rubber, with an aperture in the center. The movement casing then is placed over the aperture on one side of the band. Further, a lock piece is positioned over the aperture on the opposite side of the band, and removably affixed to the movement casing. The lock piece has a flange that extends over the band, so that a portion of the band around the aperture is sandwiched between the movement casing and the lock piece. In this manner, the movement casing is securely held in place on the watch band so that the movement casing and the watch band appear to be integrally formed. While this type of configuration provides an appearance of watch components being integrally formed, this structure requires the use of a relatively thick movement casing to protect the movement.

SUMMARY

The following presents a general summary of aspects of the invention in order to provide a basic understanding of the invention and various features of it. This summary is not intended to limit the scope of the invention in any way, but it simply provides a general overview of the invention and context for the more detailed description that follows.

In general, aspects of this invention relate to watches or other wrist-borne structures. Such structures in accordance with examples of this invention include: (a) a wrist band assembly (such as a watch band) defining a recess and a first aperture; (b) an electronic or mechanical device assembly (such as a watch timepiece movement assembly) having a first control element (such as a first crown stem) positioned in the recess so as to be accessible at the first aperture; and (c) a first user interaction element (such as a crown member) engaged with the first control element via the first aperture. The first user interaction element may be at least partially located external to the recess and at least partially on an opposite side of a wall defining the recess from the first control element. Watches or other wrist-borne structures in accordance with examples of this invention may include any desired number of control elements (e.g., crown stems, etc.) that extend through any desired number of apertures in the recess wall and are engaged with any desired number of user interaction elements (e.g., crown members).

Additional aspects of this invention relate to methods for assembling watches or other wrist-borne structures, e.g., like those described above. Such methods may include: (a) positioning an electronic or mechanical device assembly (such as a watch timepiece movement assembly) having at least a first control element (e.g., a crown stem) within a recess defined by a wrist band assembly (such as a watch band assembly) such that the first control element is accessible through a first aperture defined in a wall of the recess of the wrist band assembly; and (b) engaging a first user interaction element (e.g., a crown member) with the first control element through the first aperture, wherein the first user interaction element is at least partially located external to the recess and at least partially on an opposite side of a wall defining the recess from the first control element.

BRIEF DESCRIPTION OF THE DRAWINGS

A more complete understanding of the present invention and certain advantages thereof may be acquired by referring to the following detailed description in consideration with the accompanying drawings, in which.

Figure 1:
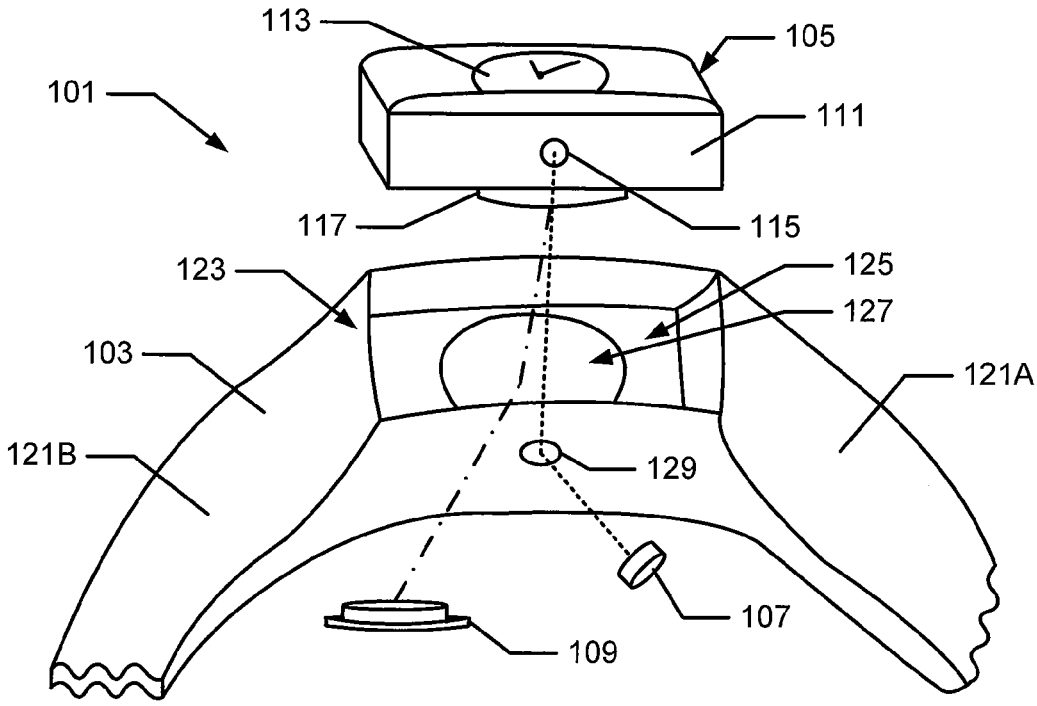
FIG. 1 illustrates an exploded top perspective view of a watch employing a watch band assembly according to various examples of the invention.
Figure 2:
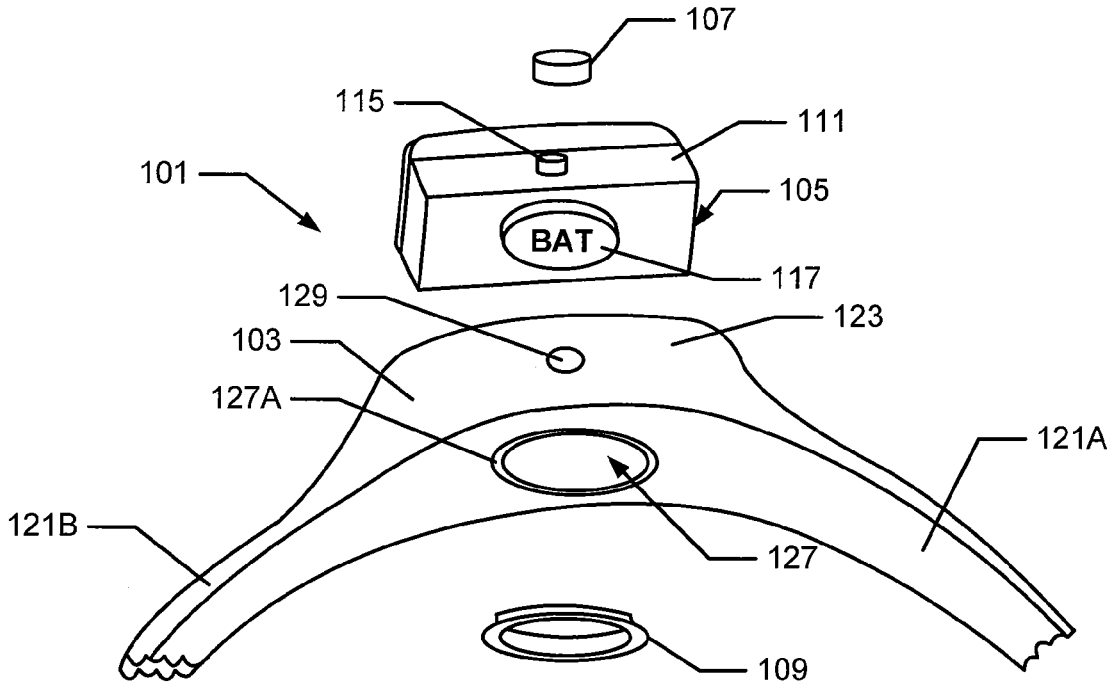
FIG. 2 illustrates an exploded bottom perspective view of a watch employing a watch band assembly according to various examples of the invention.

The reader is advised that the attached drawings are not necessarily drawn to scale.

DETAILED DESCRIPTION OF THE INVENTION

In the following description of various example structures in accordance with the invention, reference is made to the accompanying drawings, which form a part hereof, and in which are shown by way of illustration various example watch or other wrist-borne device structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

Unless otherwise noted, the term "watch," as used herein, includes any wrist-borne device that performs any desired function, and is not limited solely to timepieces. For example, the term "watch" as used herein, unless otherwise noted, may include devices that perform a variety of functions such as a stopwatch; a pedometer or other speed/distance monitoring device; a GPS transmitter/receiver device; a calculator; an MP3 player or other music playing devices; other audio, video, communication, or electronic devices; etc.

A. General Description of Watches or Other Wrist-Borne Device Structures According to Examples of the Invention Aspects of this invention relate to watches or other wrist-borne device structures. Wrist-borne devices in accordance with examples of this invention include: (a) a wrist band assembly (such as a watch band assembly) defining a recess and a first aperture (e.g., through a wall that defines the recess); (b) an electronic or mechanical device assembly (such as a watch timepiece movement assembly) having a first control element (such as a first crown stem) positioned in the recess so as to be accessible at the first aperture; and (c) a first user interaction element (such as a crown member) at least partially located external to the recess and at least partially on an opposite side of the recess from the first control element, wherein the first user interaction element is engaged with the first control element via the first aperture (which arrangement helps secure the electronic or mechanical device assembly in place with respect to the wrist band assembly). Wrist-borne device structures in accordance with this invention may include any desired number of control elements (e.g., crown stems, etc.) that extend through any desired number of apertures in the recess and are engaged with any desired number of user interaction elements (e.g., crown members). Moreover, the apertures may be located on any desired walls of the wrist band recess without departing from this invention, including a single side wall, different side walls, opposite side walls, a bottom surface or wall, etc.

Wrist-borne device structures in accordance with examples of this invention may include additional securing features to secure the mechanical or electronic assembly with the band assembly. For example, in accordance with at least some examples of this invention, the wrist band assembly may include a second aperture defined therein, wherein the second aperture is defined in a bottom surface of the recess. A securing element may be engaged with the electronic or mechanical device assembly at this second aperture to help hold the various parts in place with respect to one another.

Additionally, if desired, a portion of the wrist band assembly forming the recess may constitute a unitary, one piece construction with a majority of the overall wrist band assembly. In some example structures in accordance with this invention, the entire wrist band assembly may constitute a single, one piece, unitary construction. The wrist band may be secured to a user's wrist in any desired manner, including via a buckle fastener, a hook-and-loop fastener, other mechanical clasps or connector assemblies, through an elastic or other stretchable element, etc., including in manners that are conventional and known in the art.

B. General Description of Example Methods of Assembling Watches and Other Wrist-Borne Device Structures According to the Invention Additional aspects of this invention relate to methods for assembling wrist-borne device structures (such as watches), e.g., having structures like those described above. Such methods may include: (a) positioning an electronic or mechanical device assembly (such as a watch timepiece movement assembly) having at least a first control element (e.g., a crown stem) within a recess defined by a wrist band assembly (such as a watch band assembly) such that the first control element is accessible at a first aperture defined in the wrist band assembly; and (b) engaging a first user interaction element (e.g., a crown member) with the first control element via the first aperture, wherein the first user interaction element is at least partially located external to the recess and at least partially on an opposite side of a wall defining the recess from the first control element. The wrist band assembly, electronic or mechanical device assembly, and/or user interaction element(s) may have any of the additional elements, desired features, or combination of features described above.

Specific examples of the invention are described in more detail below. The reader should understand that these specific examples merely illustrate examples of the invention, and they should not be construed as limiting the invention.

C. Specific Examples of the Invention

FIGS. 1-4 illustrate a first example of a watch structure 101 employing a watch band assembly according to various examples of the invention. As seen in these figures, this example watch structure 101 includes a watch band assembly 103, a movement assembly 105, a crown 107, and a lock piece 109.

With this illustrated implementation of the invention, the movement assembly 105 includes a movement cover 111, a watch movement (not shown) within the movement cover 111, a display 113 positioned over the movement cover 111, and a crown stem 115 (or other control element) for the watch (or other device). As will be understood by those of ordinary skill in the art, the crown stem 115 can be rotated to control the operation of the watch movement (e.g., to set the time, to set a day, date or other calendar element, etc.). It also should be appreciated that, with various examples of structures in accordance with this invention, the movement cover 111 may be reduced in size or omitted altogether. Additionally, the display 113 may be analog, digital, include plural independent displays, etc., without departing from this invention.

In this illustrated example structure 101 according to the invention, the watch movement is an electronic movement, such as a quartz movement. The movement therefore includes a battery compartment (not shown) for holding a battery to power the watch movement. In addition, the movement assembly 105 includes a battery cover 117 for securing the battery in contact with the movement. It should be appreciated, however, that with alternate examples of the invention, the movement 105 may be a mechanical movement that operates using an arrangement of springs and gears to store and release kinetic energy. A variety of both quartz and mechanical movements are well known in the art, and thus will not be detail in more detail here. Additionally or alternatively, if desired, other electronic or mechanical assemblies, e.g., for performing other desired functions, may be included in the structure 101 without departing from this invention.

The watch band assembly 103 of this example structure 101 includes a pair of watch band segments 121A and 121B on opposite sides of a movement casing segment 123. As seen in FIG. 1, the movement casing segment 123 defines a recess 125 including one or more side walls. The movement casing segment 123 also defines an aperture 127 in the bottom of the recess 125, and at least one aperture 129 in one or more of the side walls defining the recess 125. With this illustrated example of the invention, the recess 125 in the movement casing segment 123 has a depth that is approximately equal to the height of the movement assembly 105. As will be described in more detail below, this configuration allows the movement casing segment 123 to provide some protection for the display 113.

The watch band assembly 103, including band segments 121A and 121B, may be made from any desired material(s) without departing from this invention, including materials that are conventional and known in the art. In some structures in accordance with this invention, the watch band assembly 103, including the movement casing segment 123 and at least a majority of band segments 121A and 121B, will be made from a continuous, single piece of material. Optionally, if desired, this material will be flexible, at least in the band segments 121A and 121B to comfortably adjust to and fit the wearer, while still rigid enough (at least in segment 123) to securely hold (and optionally at least partially protect) the movement assembly 105 and/or display 113. Various polymer materials, including thermoplastic polyurethane polymers (TPUs), thermoplastic elastomeric materials, PEBAX, DESMOPAN, and the like, may be used without departing from this invention. As additional examples, leathers, textiles, metals, or other materials also may be used without departing from this invention.

When the watch 101 is assembled, the movement assembly 105 is placed inside of the recess 125 defined in the movement casing segment 123. More particularly, the movement assembly 105 is placed inside of the recess 125 so that the battery cover 117 lies adjacent to and/or passes into or through the aperture 127 in the bottom of the recess 125, and so that the crown stem 115 (or other control element region) lies adjacent to or passes into or through the aperture 129. With this illustrated example of the invention, the movement assembly 105 has only a single crown stem 115. Accordingly, the movement casing segment 123 defines only the single aperture 129 corresponding to the crown stem 115. It should be appreciated, however (and as will be explained in more detail below in conjunction with FIGS. 5A through 6B), that other examples of the invention may employ a movement assembly 105 having two, three, four or even more crown stems 115. For example, the movement assembly 105 may have two crown stems 115 facing one side of the movement casing segment 123 parallel to the direction of the band segments 121 and two crown stems 115 facing the other side of the movement casing segment 123 parallel to the direction of the band segments 121A and 121B. With these alternate examples of the invention, the movement casing segment 123 will define multiple apertures 129, e.g., such that the movement casing segment 123 defines an aperture 129 corresponding to each crown stem 115 of the movement assembly 105. Other arrangements of crown stems or other control elements and/or apertures are possible without departing from this invention.

Alternatively, if desired, the recess 125 may be symmetrically shaped and formed to include apertures 129 on opposite side walls of the recess 125 even if the movement assembly 105 has a single crown stem. In this manner, the movement assembly 105 (which also may be symmetrically shaped) can be reversibly mounted in the recess (e.g., for right or left handed wearers).

Figure 3:
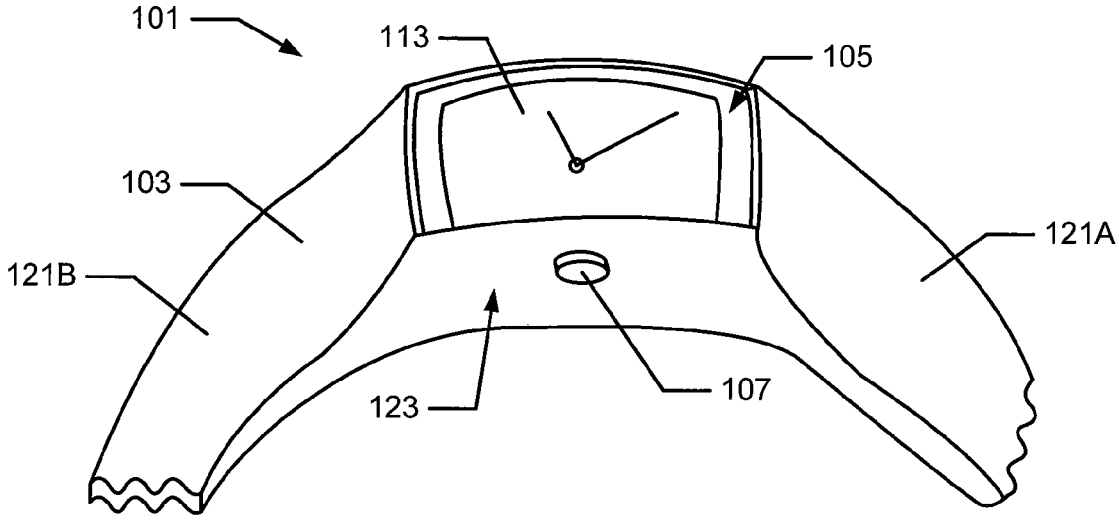
FIG. 3 illustrates a top perspective view of a watch employing an assembled watch band assembly according to various examples of the invention.
Figure 4:
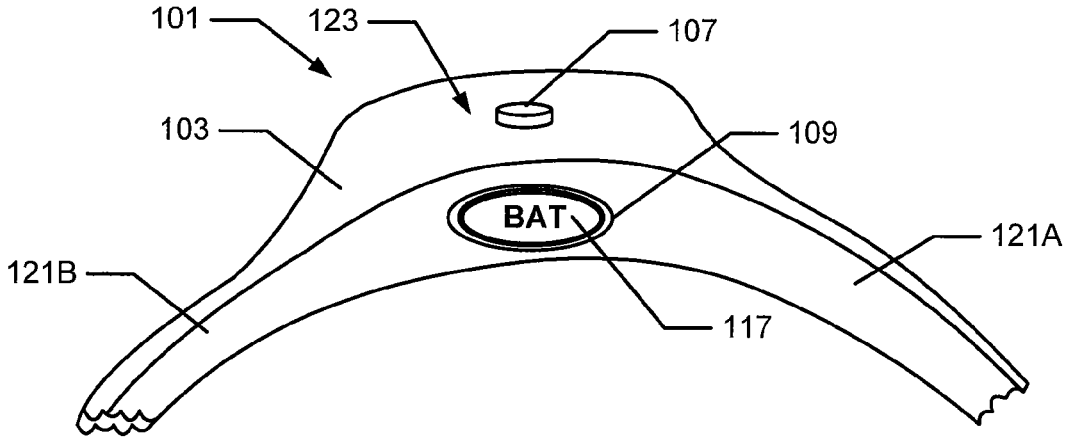
FIG. 4 illustrates a bottom perspective view of a watch employing an assembled watch band assembly according to various examples of the invention.

Once the movement assembly 105 has been positioned within the recess 125 defined by the movement casing segment 123, a crown 107 is mounted onto the free end of each crown stem 115, as shown in FIGS. 3 and 4. In this manner, a portion of the movement casing segment 123 around the periphery of each aperture 129 may be sandwiched between the movement assembly 105 and a crown 107. This configuration and arrangement helps securely engage the movement assembly 105 with the watch band assembly 103 within the recess 125.

With this illustrated example structure 101 according to the invention, lock piece 109 is secured to the bottom of the movement cover 111 (or to the movement itself if the movement cover 111 is omitted), as shown in FIG. 4. Thus, a portion (127A) of the movement casing segment 123 around the periphery of the bottom aperture 127 may be sandwiched between the movement assembly 105 and the lock piece 109. The lock piece 109 may be secured to the bottom of the movement cover 111 (or to another part of the movement and/or watch band assembly structures) in any desired manner without departing from this invention, including, for example: by a threaded engagement arrangement; by a tight friction fit; by a detent structure, retaining element structure, clasp structure, or other mechanical engagement structure; by an adhesive or cement; etc. This configuration helps to further securely affix the movement assembly 105 to the band assembly 103 and within the recess 125. It should be appreciated, however, that the lock piece 109 may be omitted from alternate implementations of the invention. For example, if the movement assembly 105 employs a crown stem 115 on the opposite side of the recess 125 (e.g., two opposing crown stems 115), then the crowns 107 fixed to the ends of the crown stems 115 may serve to securely hold the movement assembly 105 within the recess 125 without the need for an additional lock piece 109. It should further be appreciated that, with some example structures in accordance with the invention where the lock piece 109 is omitted, the bottom aperture 127 may be omitted as well. Such arrangements will be described in more detail below in conjunction with FIGS. 5A through 6B.

As previously noted, with various examples of the invention, the depth of the recess 125 may be approximately equal to or even slightly greater than the height of the movement assembly 105. As seen in FIG. 3, with this configuration, the upper perimeter of the movement casing segment 123 will be at the same level or somewhat higher than the display 113 of the movement assembly 105 (and/or any crystal, glass, cover member, or the like that is included as part of or overlies the display 113). Thus, it may appear as if the display 113 is somewhat recessed in the movement casing segment 123. In this type of arrangement, the upper perimeter of the movement casing segment 123 will help to protect the display 113 and/or its cover member from, for example, scratching or gouging.

Figure 5A:
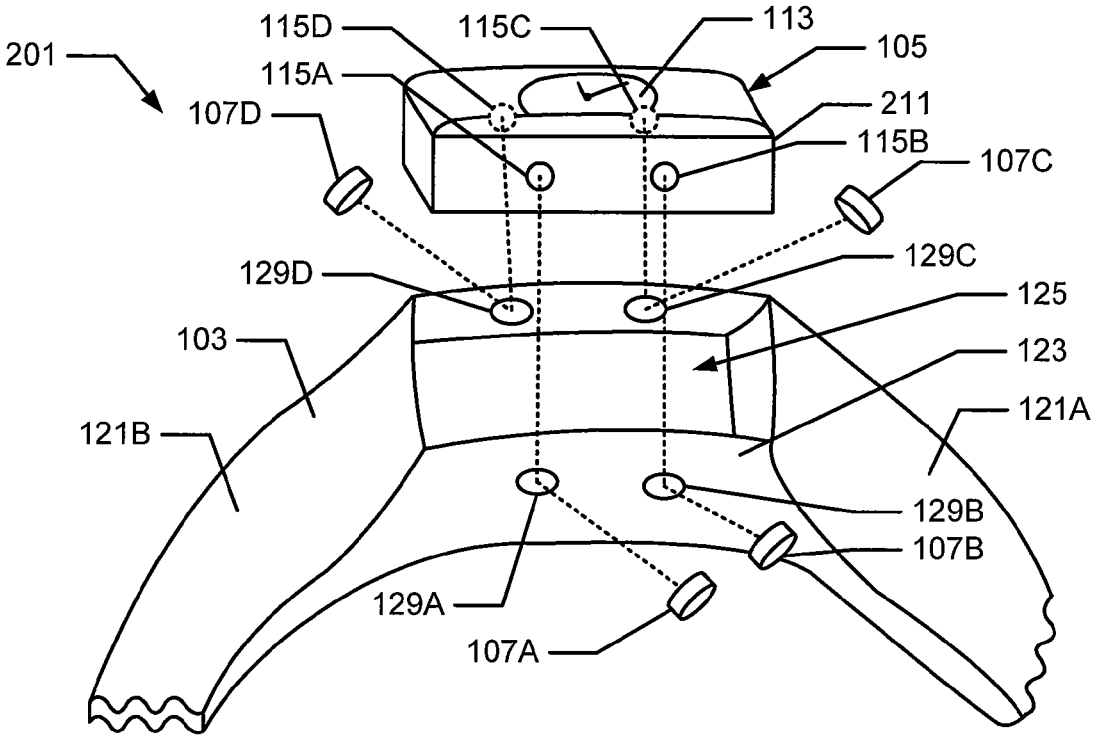
FIGS. 5A and 5B illustrate an additional example watch structure (exploded view) in accordance with this invention.
Figure 5B:
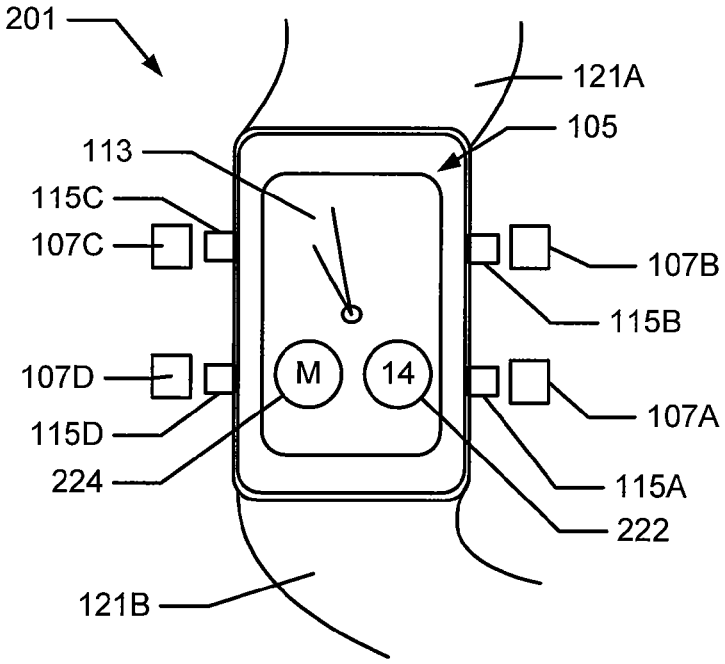

FIGS. 5A and 5B illustrate another watch (or other device) structure 201 in accordance with at least some examples of this invention. While this structure 201 differs from the structure 101 described above in conjunction with FIGS. 1-4 in various ways, for simplicity, the same or similar parts in FIGS. 5A and 5B will be labeled with the same reference numbers as used in FIGS. 1-4, and the overlapping description will be omitted. One major difference between this structure 201 and the structure 101 of FIGS. 1-4 relates to the crown stem features. Rather than a single crown stem, the structure 201 of FIGS. 5A and 5B includes plural crown stems (four shown, namely 115A through 115D), with (in this arrangement) some crown stems located on the opposite sides of the movement cover 211. Each crown stem 115A through 115D in this structure 201 is partnered with an associated aperture 129A through 129D defined in the appropriate side wall of the recess 125. Furthermore, each crown stem 115A through 115D in this structure 201 is partnered with an associated crown member 107A through 107D to help hold the movement cover 211 in place with respect to the recess 125 and the watch band assembly 103. The additional crown stems and crowns may be used to control any desired features of the wrist-borne device 201, such as a day indicator 222, a date indicator 224, a pedometer, a stopwatch, a timer, an audio and/or video output, etc.

As described above, if desired, a portion of the side wall(s) of the recess 125, adjacent the apertures 129A through 129D, may be held between the crowns 107A through 107D, respectively, and the crown stems 115A through 115D, respectively, and/or a side wall of the movement cover 211. This feature can help securely hold the movement cover 211 in place with respect to the recess 125 and/or the band assembly 103, as described above. Notably, the inclusion of multiple crown stems on each side of the recess 125 further helps hold the movement cover 211 in place, even in the event that one of the crown stems 115A through 115D is pulled outward for use (e.g., in a normal manner, to adjust a component of the display 113, to reset a counter or timer, to start a counter or timer, etc.). Also, while not a requirement, if desired and as illustrated in this example structure 201, the crown 107A through 107D and crown stem 115A through 115D assemblies may be a sufficient securing mechanism for the movement casing 211 such that the bottom aperture 127 and locking ring structure 109 (from FIGS. 1-4) can be omitted.

The crown stems 115A through 115D may be engaged with the crown members 107A through 107D in any desired manner without departing from this invention, including in manners that are conventional and known in the art. For example, the crown members 107A through 107D may include a threaded hole that engages with threads provided on the free ends of the crown stems 115A through 115D. As another example, if desired, a tight friction fit, detent structure, retaining element structure, clasp, or other mechanical structure may be used to engage the crown members 107A through 107D with the crown stems 115A through 115D. As yet another example, if desired, an adhesive or cement may be used to engage the crown members 107A through 107D with the crown stems 115A through 115D.

Figure 6A:
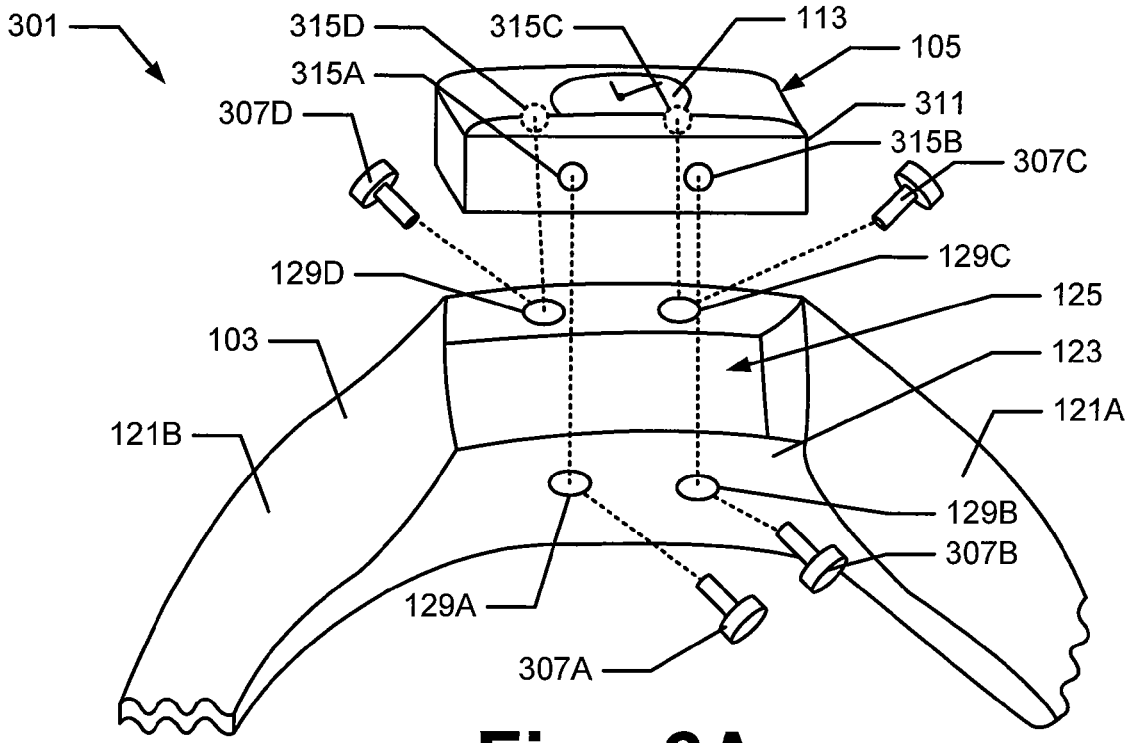
FIGS. 6A and 6B illustrate another example watch structure (exploded view) in accordance with this invention.
Figure 6B:
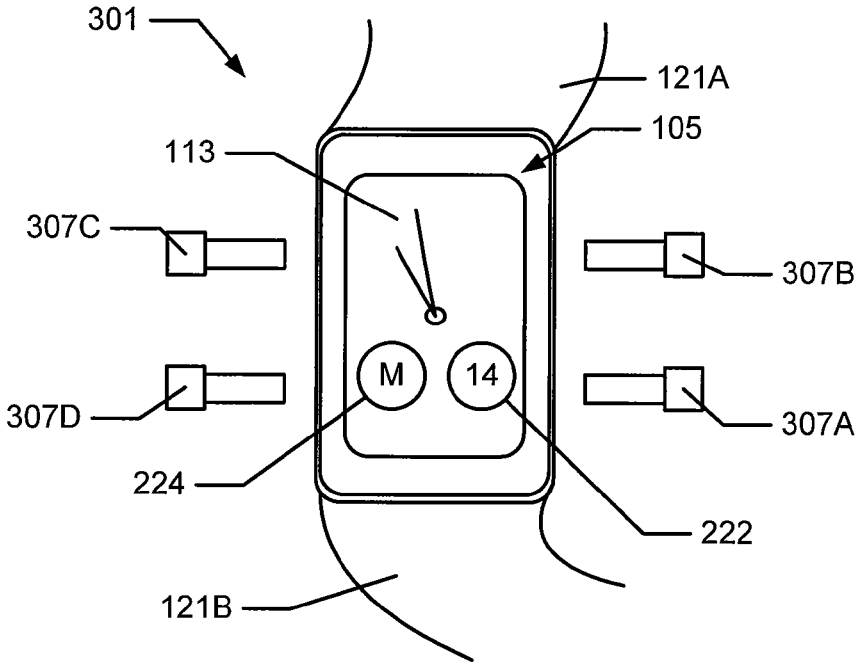

All of the wrist-borne device structures described above in conjunction with FIGS. 1 through 5B have a crown stem/crown element structure for allowing the user to interact with and/or control one or more features of the device (e.g., to set time, day, date, or provide other control setting or command features). FIGS. 6A and 6B illustrate an example of such a watch (or other device) structure 301 in accordance with this invention. While this structure 301 differs from the structures 101 and 201 described above in conjunction with FIGS. 1-5B in various ways, for simplicity, the same or similar parts in FIGS. 6A and 6B will be labeled with the same reference numbers as used in FIGS. 1-5B, when appropriate, and the overlapping description thereof will be omitted.

As illustrated in FIGS. 6A and 6B, rather than a crown stem/crown structure, the structure 301 of FIGS. 6A and 6B includes plural user interaction elements 307A through 307D in the form of pegs that extend through the apertures 129A through 129D of the recess 125 and into an associated control element 315A through 315D provided with the movement casing 311 and/or the movement (e.g., a hole provided in the side wall of movement casing 311). While any number of interaction elements and/or control elements may be provided on a given device structure 301, four interaction element and control element sets are illustrated in this example structure 301, with (in this arrangement) some interaction element/control element sets located on opposite sides of the movement cover 311. Each interaction element/control element set in this structure 301 is partnered with an associated aperture 129A through 129D defined in the appropriate side wall of the recess 125. Furthermore, each interaction element 307A through 307D in this structure 301 is partnered with an associated control element 315A through 315D to help hold the movement cover 311 in place with respect to the recess 125 and the watch band assembly 103. As described above, the additional interaction element/control element set in this structure 301 may be used by users to control other features of the wrist-borne device 301, such as a day indicator 222, a date indicator 224, to reset or clear a counter or other data element, to start a counter or timer, etc.

If desired, a portion of the side wall(s) of the recess 125, adjacent the apertures 129A through 129D, may be held between the interaction element 307A through 307D, respectively, and its respective the control element 315A through 315D, and/or a side wall of the movement cover 311. This feature can help securely hold the movement cover 311 in place with respect to the recess 125, as described above. Notably, the inclusion of multiple interaction element/control element sets on each side of the recess 125 further helps hold the movement cover 311 in place, even in the event that one of the interaction elements 307A through 307D is pulled outward for use (e.g., in a normal manner). Also, while not a requirement, if desired and as illustrated in this example structure 301, the multiple interaction element/control element sets may be a sufficient securing mechanism such that the bottom aperture 127 and locking ring structure 109 (from FIGS. 1-4) can be omitted (although such structures still may be included in the device structure 301, if desired, without departing from this invention).

The interaction elements 307A through 307D may be engaged with the control elements 315A through 315D in any desired manner without departing from this invention, including in manners that are conventional and known in the art. For example, the control elements 315A through 315D may include a threaded hole, sleeve, or side wall that engages with threads provided on the free end of the interaction elements 307A through 307D. As another example, if desired, a friction fit, detent structure, retaining element, clasp, or other mechanical structure may be used to engage the interaction elements 307A through 307D with their respective control elements 315A through 315D. As yet another example, if desired, an adhesive or cement may be used to engage the interaction elements 307A through 307D with the control elements 315A through 315D.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A watch, comprising:

a watch band assembly defining a recess and at least a first aperture;

a movement assembly having at least a first crown stem corresponding to the first aperture and positioned in the recess so that the first crown stem passes through the first aperture; and a first crown mounted to the first crown stem, the first crown being engaged with the first crown stem and at least a portion of the watch band assembly around a periphery of the aperture to secure the movement assembly to the watch band assembly.

2. A watch according to claim 1, wherein the first aperture is defined in a side wall of the recess.

3. A watch according to claim 1, wherein the watch band assembly includes a second aperture defined therein, wherein the movement assembly includes a second crown stem, wherein the movement assembly is positioned in the recess so that the second crown stem passes through the second aperture, and wherein the watch further includes a second crown mounted on the second crown stem.

4. A watch according to claim 3, wherein the first aperture and the second aperture are defined in a single side wall of the recess.

5. A watch according to claim 3, wherein the first aperture and the second aperture are defined in opposite side walls of the recess.

6. A watch according to claim 1, wherein the watch band assembly includes a second aperture defined therein, wherein the second aperture is defined in a bottom surface of the recess.

7. A watch according to claim 6, further comprising:

a securing element for engaging the movement assembly through the second aperture.

8. A watch according to claim 1, wherein a portion of the watch band assembly forming the recess constitutes a unitary, one piece construction with a majority of the overall watch band assembly.

9. A wrist-borne device, comprising:

a wrist band assembly defining a recess and a first aperture;

an electronic or mechanical device assembly having a first control element positioned in the recess so as to be accessible at the first aperture; and a first user interaction element separate from the first control element and at least partially located external to the recess and at least partially on an opposite side of the recess from the first control element, wherein the first user interaction element is engaged with the first control element and a periphery of the first aperture to secure the electronic or mechanical device assembly to the wrist band assembly.

10. A wrist-borne device according to claim 9, wherein the first aperture is defined in a side wall of the recess.

11. A wrist-borne device according to claim 9, wherein the wrist band assembly includes a second aperture defined therein, wherein the electronic or mechanical device assembly includes a second control element, wherein the electronic or mechanical device assembly is positioned in the recess so that the second control element is accessible at the second aperture, wherein the wrist-borne device further includes a second user interaction element at least partially located external to the recess and at least partially on the opposite side of the recess from the second control element, and wherein the second user interaction element is engaged with the second control element via the second aperture.

12. A wrist-borne device according to claim 11, wherein the first aperture and the second aperture are defined in a single side wall of the recess.

13. A wrist-borne device according to claim 11, wherein the first aperture and the second aperture are defined in opposite side walls of the recess.

14. A wrist-borne device according to claim 9, wherein the wrist band assembly includes a second aperture defined therein, wherein the second aperture is defined in a bottom surface of the recess.

15. A wrist-borne device according to claim 14, further comprising:

a securing element for engaging the electronic or mechanical device assembly via the second aperture.

16. A wrist-borne device according to claim 9, wherein a portion of the wrist band assembly forming the recess constitutes a unitary, one piece construction with a majority of the overall wrist band assembly.

17. A method for assembling a watch, comprising:

positioning a movement assembly having at least a first crown stem within a recess defined by a watch band assembly such that the first crown stem passes through a first aperture defined in the watch band assembly;

mounting a first crown to the first crown stem; and engaging the first crown with the crown stem and at least a portion of the watch band assembly around a periphery of the first aperture thereby securing the movement assembly to the watch band assembly.

18. A method according to claim 17, wherein the first aperture is defined in a side wall of the recess.

19. A method according to claim 17, wherein the watch band assembly includes a second aperture defined therein, wherein the movement assembly includes a second crown stem, wherein the positioning includes positioning the movement assembly in the recess so that the second crown stem passes through the second aperture, and wherein the method further includes mounting a second crown to the second crown stem.

20. A method according to claim 19, wherein the first aperture and the second aperture are defined in a single side wall of the recess.

21. A method according to claim 19, wherein the first aperture and the second aperture are defined in opposite side walls of the recess.

22. A method according to claim 17, wherein the watch band assembly includes a second aperture defined therein, wherein the second aperture is defined in a bottom surface of the recess, and wherein the method further includes engaging a securing element with the movement assembly through the second aperture.

23. A method according to claim 17, wherein a portion of the watch band assembly forming the recess constitutes a unitary, one piece construction with a majority of the overall watch band assembly.

24. A method for assembling a wrist-borne device, comprising:

positioning an electronic or mechanical device assembly having a first control element within a recess defined by a wrist band assembly such that the first control element is accessible at a first aperture defined in the wrist band assembly; and engaging a first user interaction element separate from the first control element with the first control element and a periphery of the first aperture to secure the electronic or mechanical device assembly to the wrist band assembly, wherein the first user interaction element is at least partially located external to the recess and at least partially on an opposite side of the recess from the first control element.

25. The method according to claim 24, wherein the wrist band assembly includes a second aperture defined therein, wherein the electronic or mechanical device assembly includes a second control element, wherein the positioning includes positioning the electronic or mechanical device assembly in the recess so that the second control element is accessible at the second aperture, and wherein the method further includes engaging a second user interaction element with the second control element via the second aperture, wherein the second user interaction element is at least partially located external to the recess and at least partially on the opposite side of the recess from the second control element.

* * * * *